US012336617B2

(12) United States Patent
Vanoncini et al.

(10) Patent No.: US 12,336,617 B2
(45) Date of Patent: Jun. 24, 2025

(54) WIPER EQUIPPED WITH AN INSERT

(71) Applicant: BRIVAPLAST S.r.l., Milan (IT)

(72) Inventors: Andrea Vanoncini, Milan (IT); Lara Cannella, Milan (IT)

(73) Assignee: BRIVAPLAST S.R.L., Milan (IT)

( * ) Notice: Subject to any disclaimer, the term of this patent is extended or adjusted under 35 U.S.C. 154(b) by 0 days.

(21) Appl. No.: 18/603,644

(22) Filed: Mar. 13, 2024

(65) Prior Publication Data

US 2024/0306798 A1 Sep. 19, 2024

(30) Foreign Application Priority Data

Mar. 15, 2023 (IT) ..... 102023000004896

(51) Int. Cl.
*A45D 40/26* (2006.01)
*A45D 34/04* (2006.01)

(52) U.S. Cl.
CPC ..... *A45D 40/267* (2013.01); *A45D 34/046* (2013.01)

(58) Field of Classification Search
CPC .. A45D 34/046; A45D 34/043; A45D 34/042; A45D 34/045; A45D 34/047; A45D 40/267; A45D 40/264; A45D 40/262; A45D 40/265; A45D 40/268
USPC ..... 401/121, 122, 126–130
See application file for complete search history.

(56) References Cited

U.S. PATENT DOCUMENTS 3,817,637 A * 6/1974 Vasas ..... A45D 34/046 401/122
3,861,810 A * 1/1975 Vasas ..... A45D 40/267 401/122
4,796,647 A * 1/1989 Gueret ..... A45D 40/267 401/122
5,597,254 A 1/1997 Vasas
6,076,985 A * 6/2000 Gueret ..... A45D 34/046 401/121

FOREIGN PATENT DOCUMENTS

JP 2004194773 A 7/2004
JP 2006263233 A 10/2006
WO 2019/042886 3/2019

OTHER PUBLICATIONS

Search Report for Italian Application No. 102023000004896 dated Sep. 6, 2023.

* cited by examiner

*Primary Examiner* — David J Walczak
(74) *Attorney, Agent, or Firm* — Chrisman Gallo Tochtrop LLC

(57) ABSTRACT

Wiper for containers of cosmetic products in paste of the type including a rigid frame provided with a flange at the top and a dome-shaped base including a cylindrical body internally provided with a toroidal groove and a centrally drilled, dome-shaped appendix so that a wiping surface is identified. The appendix is of elastic material and is arranged integral with the cylindrical body. The frame and the base are interlockingly connected with each other and on the internal surface of the dome-shaped base is provided a wiping wall equipped with a central hole according to the geometry of the hole of the base.

7 Claims, 4 Drawing Sheets

WIPER EQUIPPED WITH AN INSERT

FIELD OF THE INVENTION

The present invention relates to the field of cosmetics, in particular it aims at describing an improved wiper.

STATE OF THE PREVIOUS ART

Cosmetic formulations in paste or gel are typically stored in a substantially closed vessel, except for an opening provided on a collar, usually threaded or equipped with engagement means with complementary means provided on the internal walls of a cap body having a shape complementary to that of said opening, which houses a rod inside it—typically fixed at the closing top of said cap—at the distal end of which an applicator is provided.

Since cosmetic formulations typically suffer from the ingress of air or light, because these agents could dry out the product or segregate other solvents and could form clumps of the product, it is foreseen to mount a wiper on the upper surface of the opening collar, that is a body substantially frusto-conical with a flanged element at its base. The wiper, usually made of plastic material, is inserted in the collar so that the base experiences resistance at the top of the collar itself and the with a hole top is arranged inside the vessel. The applicator is passed through the central hole, so that—when not in use—the structure results in maximum air and light tightness.

In addition to the function of isolating from the surrounding environment, the wiper plays a significant role during the extraction phase of the applicator from the container, as it frees the peripheral portion of the applicator itself from excess cosmetic, minimizing the risk of unwanted over-application, with the well-known and undesirable effects of smudging and clumping. This essential property becomes complex in some cases due to the fact that the applicator can have the most diverse shapes and consequently the engagement area of the wiper with the applicator must be sufficiently elastic to be able to lap every possible specific shape and wipe off excess substances.

A further task of the wiper is to minimize the risk that undesired quantities of cosmetic material remain along the rod—at the end of the extraction of the applicator body from the container—both to reduce material waste and to prevent any undue contact with elements outside the area of makeup application from soiling the user's skin or clothing. It is therefore a fundamental requirement of cosmetic product containers that the activity performed by the wiper on the entire area that comes in contact with the substance to be applied is precise and effective.

In order to solve these issues, cosmetic manufacturers have long been accustomed to designing the wiper element to be made of a non-breathable material having elastic properties.

However, over time, there has been a need to obtain a wiper made of plastic materials with different physical properties, so as to maintain the engagement area with the applicator with the desired elastic properties, while the other element exhibits higher stiffness.

This has led to the development of two-component wipers, wherein means of mutual engagement are provided between the two portions of different material, in a way ensuring the proper sealing of the wiper system, even during extraction phase.

Among various solutions, WO 2019/042886 discloses a wiper assembly comprised of the combination of two separate and distinct elements, an upper body with a substantially cylindrical shape and a lower body with a substantially dome-shaped profile with a hole on the bottom surface. The cited patent also discloses a solution where a sponge is inserted beneath the secondary wiper portion of the collar, with particularly complex design solutions. In particular, the presence of sealing tips or adhesives elements of the structure, or the use of welding (laser and sonic) is provided.

The concept of a sponge element arranged downwards of a wiper has most likely the function of substantially prolonging the wiping function offered by the hole located at the bottom end of the dome-shaped element. The sponge in fact reduces the excess of paste provided on the applicator, partly acting as a pre-wiper and partly maintaining its sponge function by absorbing material. The applicator can thus arrive at the wiping point cleaner, thereby reducing the substance that needs to be removed and allowing the dome-shaped element to have less pronounced elastic properties.

Such a solution proves cumbersome, as it requires a series of specific post-assembly operations that slow down the preparation process. Furthermore, it has been observed that the exit of the applicator from the container does not guarantee in any way the fact that the applicator is loaded with the correct amount of substance, without the risk of creating smudges: it is in fact evident that the structure created cannot guarantee the absorption of excess material remaining on the applicator after wiping, but rather serves to roughly remove the substance contained on the applicator body.

It is therefore an objective of the present invention to obtain a wiper which is composed of multiple materials, which can be assembled differently according to production needs and that simultaneously presents means to ensure the correct absorption of the excess cosmetic paste load after mechanical and gravitational removal of the excess paste from the applicator.

Furthermore, it has been observed that the material deposited inside the frame in contact with the external environment undergoes a rapid degradation of its physico-chemical characteristics: the possible reinsertion of the applicator assembly, i.e. the head and rod, in the container poses the risk that the internal material may be contaminated with the product that has been in contact with the external environment, thus reducing the general quality of the product present in the container for future applications.

Users, increasingly mindful of the issues related to product quality, as well as hygiene, have therefore requested solutions that reduce this risk in a satisfactory way and ensure the necessary quality of applied product over time.

It is therefore a further object of the present invention to provide a solution that ensures the achievement of a clean rod in an even more accurate way than other solutions currently on the market, in order to reduce the risk of waste and unwanted smudges.

Said object is obtained by means of a wiper for containers of cosmetic products in paste of the type composed of a rigid frame provided with a flange at the top and a dome-shaped base comprising a cylindrical body internally provided with a toroidal groove and a centrally drilled, dome-shaped appendix so that a wiping surface is identified, said appendix being integrally arranged with the cylindrical body, characterized in that said frame and said base are interlockingly connected with each other and that on the internal surface of said dome-shaped base is provided a wiping wall equipped with a central hole according to the geometry of said hole of said dome-shaped base.

The dependent claims describe preferred features of the invention.

BRIEF DESCRIPTION OF THE DRAWINGS

Further features and advantages of the invention will anyway become apparent from the following detailed description of a preferred embodiment, given purely by way of example and not limiting and illustrated in the accompanying drawings, wherein:

FIG. 1 is a perspective view of an embodiment of the present invention, of which

DETAILED DESCRIPTION OF THE PREFERRED EMBODIMENT

Figure 1:
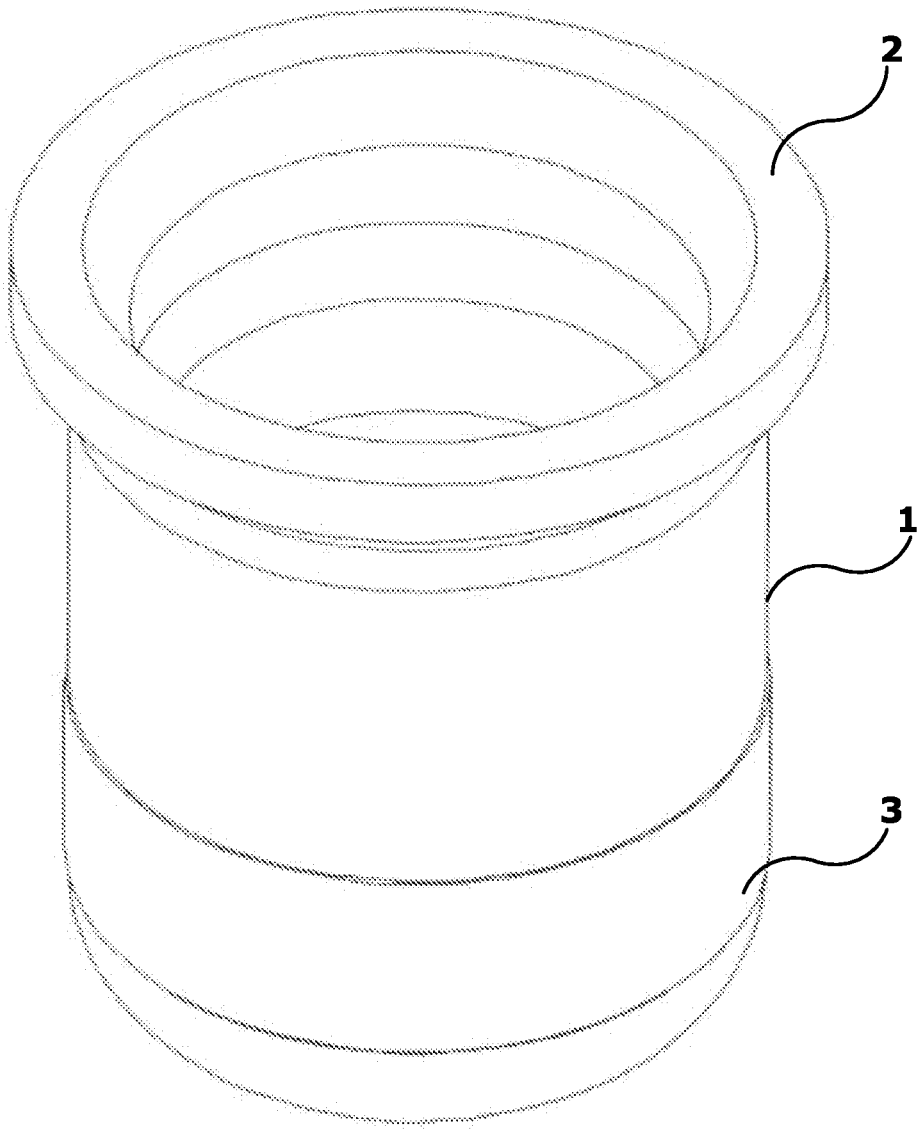
Figure 2:
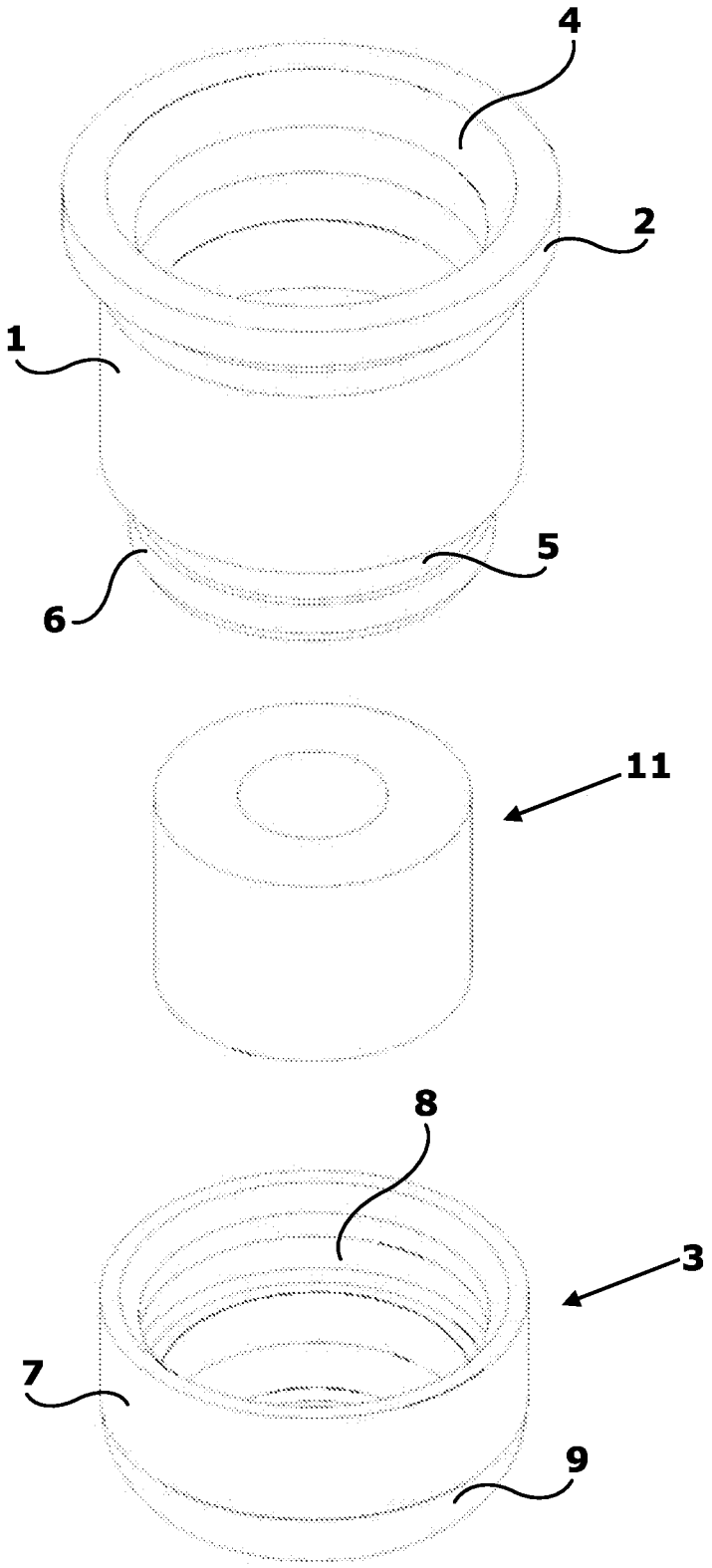
FIG. 2 is an exploded view.

The present invention relates to an easily constructible cosmetic wiper, comprising a frame 1 equipped with stop flange 2 at the top and a dome-shaped base 3 engaged with said frame 1 made of elastic material.

In correspondence with its upper surface, the frame 1 has an invitation flaring 4, and in correspondence with the distal end, it has a narrowing from which a cylindrical collar 5 provided with an outward facing toroidal thickening 6 in proximity to the bottom, departs vertically. On the other hand, the base 3 comprises a cylindrical body 7 internally provided with a toroidal groove 8 and a dome-shaped appendix 9, integral with the cylindrical body 7. The dome-shaped appendix 9 is centrally drilled for the passing through of the rod and applicator bodies (not illustrated, as they are commonly used in conventional cosmetic container assemblies), so that a wiping surface 10 is identified.

Finally, an additional insert is provided comprising a centrally drilled body, whose internal surface assumes the function of wiping wall, for the passing through of the applicator body. Internally, the central body rests on the bottom surface of said dome-shaped appendix 9, or it is integrally formed with it. The maximum distance between two opposite points along the hole of said wiping wall is less than or equal to the diameter of the wiping surface 10 of the appendix 9, so that—during extraction—the applicator and the rod (not shown) at least lap the inner wall.

In the embodiment shown herein, an insert 11 made of spongy material is provided, which has substantially cylindrical profile, and is centrally drilled for the passing through of the applicator body. Preferably, the insert 11 made of spongy material has a Shore hardness not lower than 58 OO, in order to allow for greater absorption ability of the substances, not only from the applicator, but also from the rod. In particular such Shore hardness is the minimum value for the insert of spongy material to remain in place, despite being subjected to pressures from the element intended to be extracted so that the insert of spongy material is extracted along the applicator.

Figure 3:
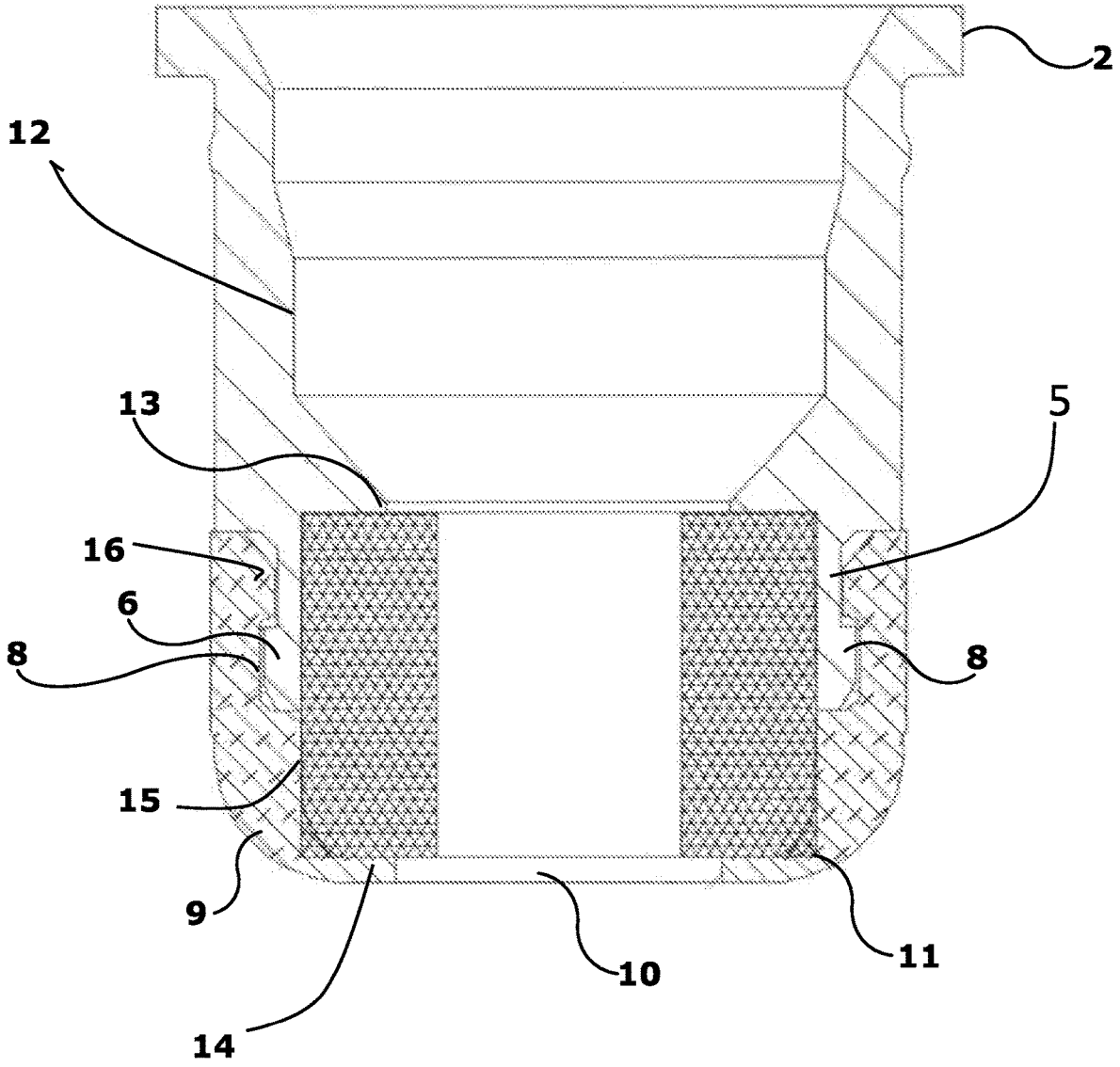
FIG. 3 is a sectional view of the present invention.
Figure 4:
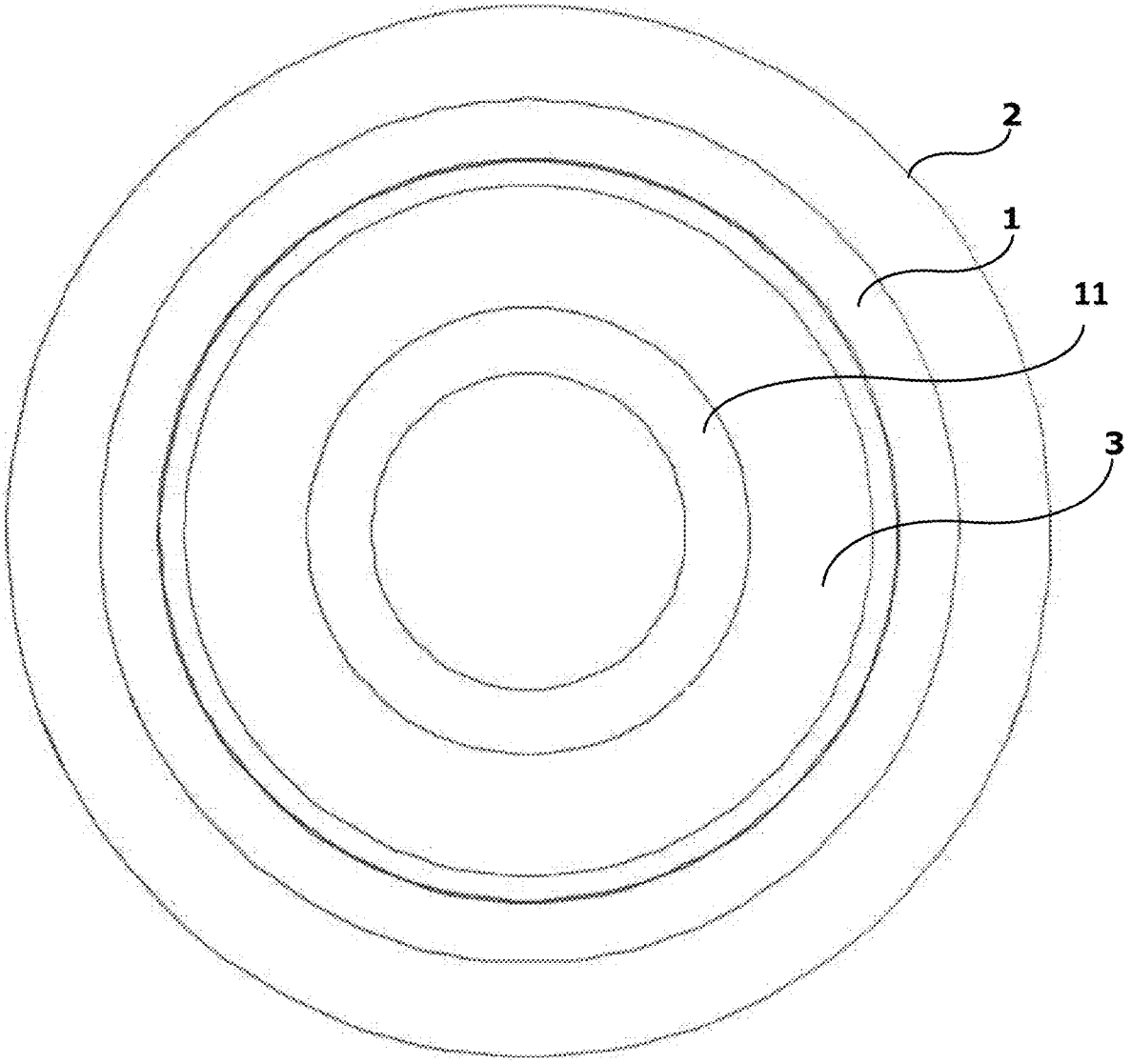
FIG. 4 is a top view of the present invention.

As illustrated in FIG. 3, the internal profile of said wiper, when assembled, provides for a vertical wall 12 at the bottom end of which projects a shoulder 13 having the lower surface horizontal, assuming the shape of an actual wedge on the internal surface of the wiper, the wall then subsequently departing again according to a vertical profile. At the bottom end the toroidal thickening 6 is found.

Likewise, the internal profile of the dome-shaped appendix 9 provides for a horizontal wall 14, from which a vertical wall 15 departs, which then caves inwards in correspondence with the groove 8, subsequently departing outwardly with a jag 16, having a smaller thickness with respect to the vertical wall 15.

As it can be well understood from FIG. 3, the above description of the internal surface of the wiper according to the invention, aims on one hand to ensure perfect sealing of the two constituting elements, and on the other hand to ensure a precise and stable seat for the insert 11: it is in fact noted that it is perfectly housed and can only be mounted in line, in order to achieve correct operation in practice.

The device thus achieved is assembled to be perfectly functional on one hand, i.e. useful for its application in a container for cosmetic products in paste, and on the other hand, to ensure the correct load of cosmetic substance on the applicator once it is extracted from the container.

Furthermore, the structure thus achieved allows to obtain the unexpected advantage of substantially and recognizably reducing the waste of unused material. It has actually been found that—in addition to the material which is recovered from the double phase removal of material from the rod and partly from the applicator, with its deposition in the container—an unexpected, yet highly sought-after advantage has been achieved: reducing the drop that occurs in conventional solutions on the tip of the applicator, which typically renders the deposition of the cosmetic unpredictable. The passing through of the bristles and the rod through the spongy material removes those amounts of material that often remain on the top of the applicator body, and which due to the shape of the applicator itself assume the form (but also the function) of a drop.

Once assembled, the wiper can be easily inserted in a conventional container for cosmetics in paste, previously filled with the material of interest, and closed with the conventional cap for shipping.

In particularly preferred embodiments, the wiping surface 10 is made of non-porous and elastic material.

Once assembled, the wiping body of the present invention is installed on an already loaded container for cosmetic formulations, and then closing it all with the conventional cap equipped with an application rod, preparing the finished product for sale.

The solution thus achieved allows to obtain the desired aim of a wiper that is capable of offering an optimal product application, without the risk of an excessive substance load on the applicator body, and simultaneously being a versatile wiper, easy to assemble and of sturdy support structure.

Furthermore, a higher cleaning effect of the entire application body, which is immersed in the cosmetic paste, is achieved thanks to the presence of a porous body having a Shore hardness not lower than 58 OO, which on one hand allows to obtain a package that increases the environmental compatibility, reducing product waste, and on the other hand allows to obtain a package that is able to reduce the unwanted deposition of substance, both in the form of smudges and in the form of dispersions in the environment.

It is understood, however, that the invention should not be considered limited to the particular arrangement illustrated above, which is only one exemplary embodiment thereof, but that different variants are possible, all within the reach of a person skilled in the art, without for this departing from the scope of protection of the invention itself, as defined by the following claims.

In particular the description has made specific reference to a wiping surface comprising a cylindrical insert, centrally drilled according to a circular geometry and made of spongy material, but it is clear that the wiping surface can be integrally formed with the dome-shaped appendix 9, and thus be of the same material, as well as of other materials useful for constituting the insert. Exemplary suitable materials are in particular silicone, zamak and silver.

What is claimed is:

1. A wiper for containers of cosmetic products in paste comprising:

a rigid frame (1) provided with a flange (2) at a top of the frame (1), wherein an internal profile of the frame provides for a vertical wall (12), a shoulder (13) projecting from a bottom end of the vertical wall (12) and being horizontal in a lower part of the shoulder (13), and a second vertical wall projecting from the lower part of the shoulder (13);

a dome-shaped base (3) comprising a cylindrical body (7) internally provided with a toroidal groove (8) and a dome-shaped appendix (9) equipped with a bottom surface with a central hole passing therethrough so that a wiping surface is defined (10), said appendix (9) being made of elastic material and being arranged integral with the cylindrical body (7), wherein said frame (1) and said base (3) are interlockingly connected with each other so that the bottom surface of the dome-shaped appendix is facing towards the second vertical wall of the rigid frame; and an insert (11) equipped with a central hole passing therethrough between a first surface and a second surface, wherein an internal surface of the central hole of the insert (11) comprises a cylindrical body that defines a wiping wall extending continuously between the first and second surfaces, a cross-sectional geometry of the central hole of the insert corresponding to said hole of said dome-shaped base (3), and wherein the insert is interposed between the rigid frame and the dome-shaped base so that the first surface of the insert abuts the shoulder of the rigid frame and the second surface of the insert abuts the bottom surface of the dome-shaped appendix so that the wiping surface is immediately adjacent to the wiping wall.

2. The wiper for containers of cosmetic products in paste according to claim 1, wherein said wiping wall provided along said insert equipped with a central hole (11) provides for a maximum distance between two opposite points taken along a surface of said hole less or equal to a maximum distance between two opposite points of said wiping surface (10).

3. The wiper for containers of cosmetic products in paste according to claim 1, wherein said frame (1) has an invitation flaring (4) in correspondence with an upper surface, and a narrowing at a distal end, from which a cylindrical collar (5) provided with an outward facing toroidal thickening (6) in proximity to a bottom of said frame, departs vertically.

4. The wiper for containers of cosmetic products in paste according to claim 1, wherein an internal profile of the dome-shaped base provides for a horizontal wall (14), from which departs a vertical wall (15), which then caves inwards in correspondence of said groove (8), departing outwardly with a jag (16), having a smaller thickness than said vertical wall (15).

5. The wiper for containers of cosmetic products in paste according to claim 1, wherein said insert equipped with a central hole (11) has a maximum distance between two opposite points taken along a surface of said hole not greater than the maximum distance of said hole of said dome-shaped appendix (9).

6. The wiper for containers of cosmetic products in paste according to claim 1, wherein said wiping wall provided along said insert equipped with a central hole (11) is made of a material selected from spongy material, silicone, zamak and silver.

7. The wiper for containers of cosmetic products in paste according to claim 6 wherein the said wiping wall provided along said insert equipped with a central hole (11) is made of spongy material having Shore hardness not lower than 58 OO.

* * * * *